US009950550B2

(12) United States Patent
Mueller

(10) Patent No.: US 9,950,550 B2
(45) Date of Patent: Apr. 24, 2018

(54) DEVICE FOR SHAPING BOOK COVERS

(71) Applicant: Mueller Martini Holding AG, Hergiswil (CH)

(72) Inventor: Hans Mueller, Lauda-Koenigshofen (DE)

(73) Assignee: MUELLER MARTINI HOLDING AG, Hergiswil (CH)

( * ) Notice: Subject to any disclaimer, the term of this patent is extended or adjusted under 35 U.S.C. 154(b) by 0 days.

(21) Appl. No.: 15/492,020

(22) Filed: Apr. 20, 2017

(65) Prior Publication Data

US 2017/0305181 A1 Oct. 26, 2017

(30) Foreign Application Priority Data

Apr. 21, 2016 (CH) ..... 0532/16

(51) Int. Cl.
*B42C 11/04* (2006.01)
*B42C 7/00* (2006.01)

(52) U.S. Cl.
CPC ..... *B42C 7/004* (2013.01); *B42C 7/005* (2013.01)

(58) Field of Classification Search
CPC ..... B42C 7/004; B42C 7/005
USPC ..... 412/19–21
See application file for complete search history.

(56) References Cited

U.S. PATENT DOCUMENTS 3,201,810 A 8/1965 Throp
5,868,539 A * 2/1999 Rathert ..... B42C 11/04 281/21.1
6,460,843 B1 * 10/2002 Dim ..... B42C 11/04 270/58.07
7,407,355 B2 * 8/2008 Schmidkonz ..... B42C 11/045 412/19
2002/0168250 A1 11/2002 Welch
2003/0215308 A1 11/2003 Rathert
2011/0123298 A1 5/2011 Mueller
2015/0273926 A1 10/2015 Meineke et al.

FOREIGN PATENT DOCUMENTS

DE 1436086 A 1/1969
DE 19853254 A1 5/2000
EP 1350634 A2 10/2003
EP 2325020 A1 5/2011
EP 2923852 A2 9/2015

* cited by examiner

*Primary Examiner* — Shin H Kim

(74) *Attorney, Agent, or Firm* — Leydig, Voit & Mayer, Ltd.

(57) ABSTRACT

A device for shaping a folding region of a lying outstretched book cover includes first and second shaping tools for book blocks having straight and round spines, respectively. A countertool has two counter shaping rails. In a working position, one of the shaping tools is aligned with an inner face of the spine region of the book cover and is configured to raise the spine region of the book cover between the two counter shaping rails to form a spine strip. A single actuator for the shaping tools is in each case arranged in the working position. A tool beam is in each case arranged in the working position and configured to be coupled to the single actuator. Each shaping tool has two shaping rails which are spaced apart, laterally adjustable and are designed so as to be adjustable collectively to change a distance therebetween.

14 Claims, 7 Drawing Sheets

DEVICE FOR SHAPING BOOK COVERS

CROSS-REFERENCE TO PRIOR APPLICATION

Priority is claimed to Swiss Patent Application No. CH 00532/16, filed on Apr. 21, 2016, the entire disclosure of which is hereby incorporated by reference herein.

FIELD

The invention relates to a device for shaping a folding region of a lying outstretched book cover, wherein the folding region being adjacent on either side of a spine region, or for shaping the spine region and the folding region, corresponding to the shape of the spine of a book block in each case which subsequently forms a book together with one of the book covers. The device has at least one first shaping tool for a book cover associated with a book block having a straight spine and at least one second shaping tool generating a rounding of the spine region of the book cover for a book cover associated with a book block having a round spine. The device also has a working position for one of the shaping tools and a resting position for the other shaping tool(s) in each case. Furthermore, the device has a countertool which is aligned with an outer face of the spine region of the book covers and has two counter shaping rails which are spaced apart from another and can be adjusted laterally according to the width of the spine region of the book cover. In this case, in its working position, the shaping tool is arranged so as to be aligned with an inner face of the spine region of a book cover, raise the spine region of the book cover between the two counter shaping rails and, in the process, form a spine strip of the book cover. Moreover, the device has a tool beam, which is non-positively or positively connected to each of the shaping tools, and is equipped with a receiving element for the tool beam of the shaping tool arranged in the working position.

BACKGROUND

The industrial finishing of hardcover books is predominantly carried out on book production lines on which book blocks are each combined with an associated book cover to produce finished books. During so-called casing in, i.e. when the book cover is bonded to the book block, the exact joining of their edges is crucial for a harmonious binding. Therefore, the prior adjustment and, if necessary, shaping, of the central region of the book cover, i.e. the spine region, which receives the spine of the book block in the finished book, is of importance for a high quality of book. Of similar importance is the shaping of the folded regions of the book cover which directly adjoin the central region on either side and later constitute the opening hinges of the finished book. The requirements for the shaping of the book cover, which is carried out under the effect of heat in each case, and therefore for the shaping tool used for this purpose differ according to whether the finished book has a rounded or angular spine and according to the form of the rounding and according to the thickness of the book. Accordingly, the shaping tools must be designed so as to be adjustable and/or interchangeable.

A book binding machine comprising a casing-in apparatus is known from DE1436086 A, in which the book cover is conveyed from a magazine into a shaping station. There, the spine region of the book cover is first shaped by a shaping tool. In order to form the folding regions separating the spine region from the lateral boards of the book cover, two fold-forming rails of a countertool are guided in opposite directions at least as far as the book cover while the shaping tool is being raised. This procedure, which is only described in very general terms in DE1436086 A, can be seen in more detail in DE19853254 A1. Therein, the spine region of the book cover is pressed against an elastically deformable supporting surface by means of a heated shaping tool designed according to the shape of the book block. In this case, the spine region is rounded and the pressed-in folding regions are made flexible. Normally, the shaping tools are kept ready in conventional shape-dependent tiers and when the spine shape of the book cover or the thickness category of the associated book block changes they are swapped over.

The manual changeover of the shaping tools that is required for this purpose, however, increases the time it takes to set up the machine. Moreover, the newly inserted shaping tools are not yet at an operating temperature and must therefore first be heated up after their installation.

On the other hand, EP1350634 A2 discloses a shaping tool for producing books having rounded spines, which comprises a rectangular frame having a plurality of adjacent lamellae that are adjustable relative to the height of the frame. In order to be able to produce book covers having differently rounded spine regions with the same book thickness, however, a plurality of shaping tools having accordingly differently adjustable lamellae must be available. Moreover, the minimum thickness of the lamellae simply has the effect of a stepped approach to a specified bending profile of the spine region. Finally, the lamellae can only be heated with considerable sluggishness due to their mobility and the necessary height.

An apparatus for shaping book covers for books having straight spines is known from EP2325020 A1. The shaping tool of said apparatus, which can be changed depending on the thickness category of the books to be produced in each case, has two shaping rails which stand vertically, are spaced apart from one another, and each rest on a tool beam by means of a base rail. The shaping rails are arranged in an initial position below and at a distance from the book cover, which is initially still in an outstretched position. In order to form the folding regions of the book cover provided on either side of the spine region, the shaping rails are raised together with their tool beam against counter shaping rails arranged thereabove. To shape the book cover, heat is applied via the shaping tools. For this purpose, the tool beam carrying the shaping tool rests on an intermediate element, which is designed as a heating element and is equipped with heating rods. The shaping tool is both brought up to an operating temperature and kept at this temperature by the heating element.

The shaping rails are each coupled to two catches, which are at a distance from one another in their longitudinal extension, are rotatably driven eccentrically about a vertical axis and are guided in the tool beam, in a guide plane by means of their respective base rails. The distance between the two support rails and therefore the width of the spine region of the book cover can be adjusted within a certain thickness category by an adjustment of the catches achieved by means of a common drive. In the process, the actuating power is introduced into the tool beams by means of an actuating mechanism arranged therebelow. An actuator is arranged in parallel with a longitudinal axis of the shaping tool.

In addition to a first shaping tool for book covers of books having straight spines, EP2923852 A2 also discloses a second shaping tool for book covers of books having round spines. Using the second shaping tool, the spine region of a book cover can be rounded while it is being raised from its outstretched position, it being possible to produce different formats and contours of the spine region. For this purpose, this shaping tool has a base element, in which a first shaping element is movably arranged such that it can be raised out of the base element. In the same manner, a second shaping element is arranged in the first shaping element, such that both shaping elements can be adjusted towards one another or towards the base element in a vertical plane to the flat outstretched book cover. On the other hand, the shaping elements of the first shaping element, which are spaced apart from one another, are adjusted in a horizontal plane to the flat outstretched book cover. Moreover, they are adjusted collectively, the distance between the shaping elements being adjusted. In order to implement this different adjustment of the two shaping tools, however, various components are required, which leads to relatively high production and replacement part costs. Because the shaping tools are equipped with identical interfaces, they can, if required, i.e. in the case of a change of order from shaping of book covers for books having straight spines to shaping of book covers of books having rounded spines, be changed for one another. In this case, both shaping elements each have a separate actuator and therefore respective associated actuating elements. Moreover, owing to the dual actuators and actuating elements, this device having a relatively long construction is, however, relatively complex and expensive. Moreover, either no assistance for the shaping by an additional application of heat via the shaping tools is provided or the newly installed shaping tool still has to be pre-heated before its first use.

SUMMARY

In an embodiment, the present invention provides a device for shaping a folding region of a lying outstretched book cover, the folding region being adjacent on either side of a spine region, or for shaping the spine region and the folding region, corresponding to the shape of the spine of a book block which subsequently forms a book together with the book cover. At least one first shaping tool for a first book cover associated with a first book block having a straight spine and at least one second shaping tool configured to generate a rounding of the spine region of the book cover for a second book cover associated with a second book block having a round spine are provided. A working position for one of the shaping tools and a resting position for the other shaping tools are provided. A countertool is aligned with an outer face of the spine region of the book cover and has two counter shaping rails which are spaced apart from one another and are adjustable laterally according to a width of the spine region of the book cover. In a working position, a respective one of the shaping tools is arranged so as to be aligned with an inner face of the spine region of the book cover and is configured to raise the spine region of the book cover between the two counter shaping rails so as to form a spine strip of the book cover. One tool beam is non-positively or positively connected to each of the shaping tools. A receiving element for the tool beam is arranged in the working position. A single actuator for the shaping tools is in each case arranged in the working position. The tool beam is in each case arranged in the working position and configured to be coupled to the single actuator. Each of the shaping tools has two shaping rails which are spaced apart from one another, are laterally adjustable and are each designed so as to be adjustable collectively to change a distance therebetween.

BRIEF DESCRIPTION OF THE DRAWINGS

The present invention will be described in even greater detail below based on the exemplary figures. The invention is not limited to the exemplary embodiments. All features described and/or illustrated herein can be used alone or combined in different combinations in embodiments of the invention. The features and advantages of various embodiments of the present invention will become apparent by reading the following detailed description with reference to the attached drawings which illustrate the following.

DETAILED DESCRIPTION

Figure 1:
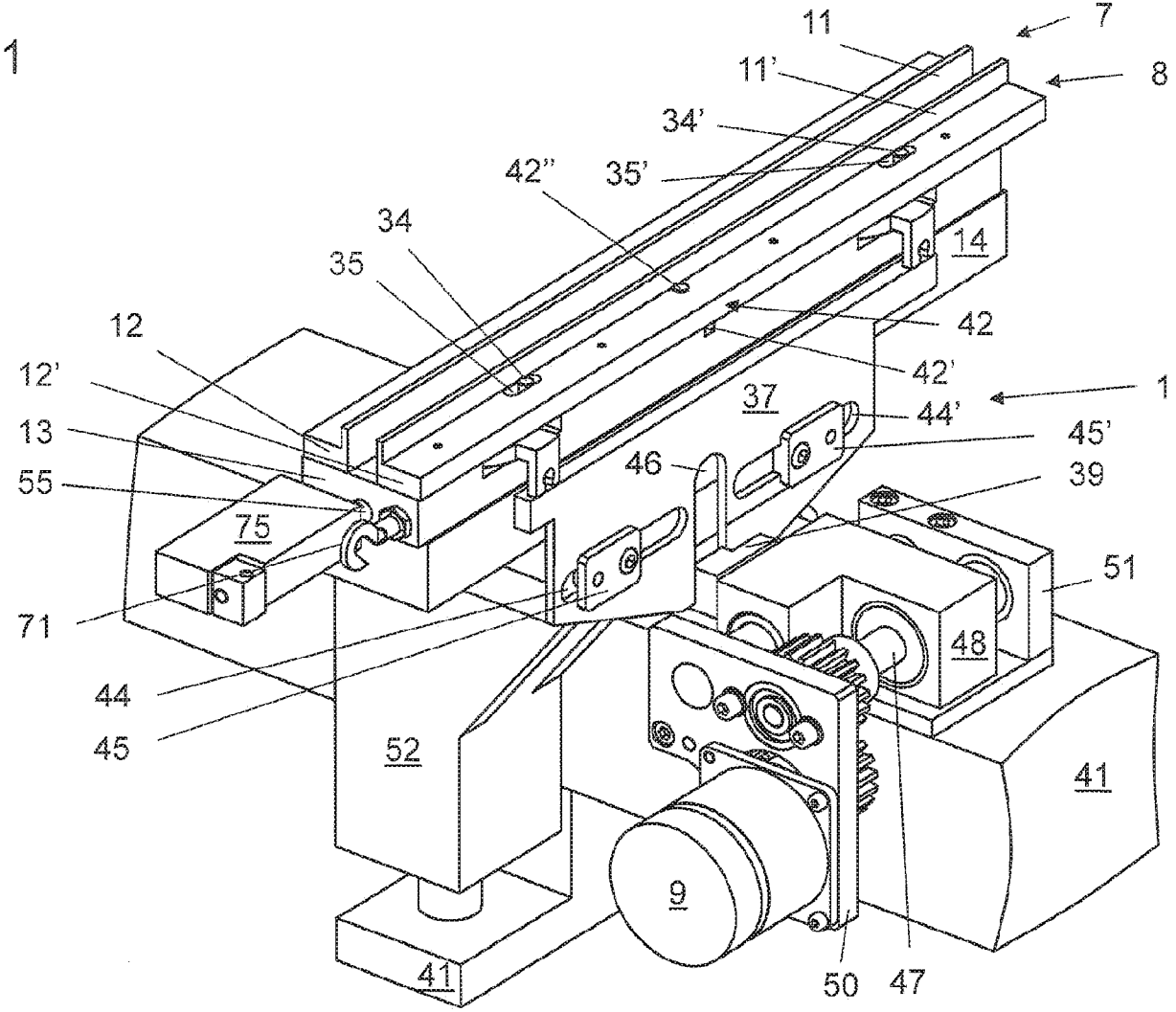
FIG. 1 is a spatial partial view of the device according to the invention for shaping book covers lying outstretched showing a first shaping tool, an actuator by way of example and its connecting element to the shaping tool.

In an embodiment, the invention provides an alternative device for shaping book covers lying outstretched, which can be changed over in a simpler and more cost-effective manner from one works order for shaping book covers for books having straight spines to a subsequent works order for shaping book covers for books having round spines and vice versa.

The device according to an embodiment of the invention has a single actuator for the shaping tool arranged in the working position in each case. The tool beam of the shaping tool arranged in the working position in each case is designed so it can be coupled to the single actuator. Each shaping tool has two shaping rails which are spaced apart from one another, are laterally adjustable and are each designed so they can be adjusted collectively so as to change the distance between them.

Owing to the use of one single actuator for the shaping rails of the shaping tool arranged in the working position in each case, the device can be produced in a relatively simple and cost-effective manner. Moreover, since all shaping tools are designed so as to be similarly adjustable, the same actuating elements can be used each time, which further reduces the production costs of the device and also reduces the cost of replacement parts.

According to one embodiment of the device according to the invention, the actuator is arranged to the side of an imaginary vertical plane through a longitudinal central axis of the tool beam located in its working position. The device can therefore be constructed so as to be very compact.

According to a further embodiment of the device according to the invention, at least one preheating station is arranged for the at least one shaping tool located in the resting position. In the event of a new works order, the relevant, already pre-heated, shaping tool is conveyed out of the resting position into the working position. Therefore, the new shaping tool is immediately ready for operation, as a result of which a relatively short order changeover can be achieved.

According to a further embodiment of the device according to the invention, the at least one preheating station of the shaping tools is arranged in or on the device or in its vicinity such that during its transportation to the device and during its installation in the device, the temperature of a shaping tool pre-heated in the preheating station does not fall, or at least not significantly, below the operating temperature required to shape the book covers subsequently to be processed. If this should be the case, the shaping tool concerned is directly, i.e. within a time period which does not or hardly impairs the time taken for the order changeover, brought up to the operating temperature by a heating element arranged in the device. If the at least one preheating station is located in or on the device or in its direct vicinity, the pre-heated and therefore hot shaping tools are protected from unauthorized access.

Production orders can be grouped together according to format change by appropriate production management and the efficiency of the machine increased since subsequent orders can be run using the same pre-heated shaping tool.

According to a next embodiment of the device according to the invention, a separate preheating station is arranged for each shaping tool. As a result, an even faster changeover of shaping tools and therefore a faster change of format can be achieved which increases the capacity of the device.

According to a further embodiment of the device according to the invention, at least one sensor for identifying the shaping tools is arranged. As a result of this identification, an error-free assignment of the shaping tools to the relevant works order is already possible and ultimately likewise an increase in capacity.

According to further embodiments of the device according to the invention, the at least one sensor is arranged in at least one of the preheating stations or on the receiving element for the tool beam. As a result, there are advantageously a number of options for identifying the shaping tools depending on the works order.

According to a next embodiment of the device according to the invention, the at least one first shaping tool has two first shaping rails which are spaced apart from one another and are arranged so as to be laterally adjustable according to the width of the spine region of the book cover. Using this solution for shaping a book cover for books having a straight spine, which is known per se, the central region of the book cover can also be shaped in interaction with the countertool in the device according to the invention using the at least one first shaping tool so as to produce both a straight spine strip of the book cover and opening hinges adjoining directly thereto on either side.

According to a further embodiment of the device according to the invention, the at least one second shaping tool has a fixed central shaping strip rounded towards the countertool and two second shaping rails which are arranged to the sides of the central shaping strip, laterally adjustable according to the rounding and the width of the spine region of the book cover, and likewise rounded towards the countertool. In the event of a corresponding order changeover from shaping book covers for books having straight spines to a second order for shaping book covers for books having round spines, both a round spine strip of the book cover and opening hinges adjoining directly thereto on either side can be produced by means of this second shaping tool, i.e. by means of the convex components, namely by means of the two second shaping rails and the central shaping strip.

According to a next embodiment of the device according to the invention, the central shaping strip is symmetrical and has, in a region facing the tool beam, one recess on either side for each receiving one of the two second shaping rails at least in part. Therefore, the second shaping rails can enter the contour of the central shaping strip in order to adjust the rounding and the width of the spine region of the book cover, which allows a relatively large operating range of the second shaping tool.

According to a further embodiment of the device according to the invention, the first and the second shaping rails are designed so as to be adjustable symmetrically to a longitudinal central axis of the central shaping strip and therefore symmetrically to the longitudinal axis of its shaping tool. Similarly to the symmetrical design of the book block, the book cover can therefore also be shaped symmetrically. This can be achieved advantageously by a single actuator.

According to a further embodiment of the device according to the invention, at least two first shaping tools each suitable for different thickness categories of spine regions of the book covers to be shaped and their associated book block and at least two second shaping tools each suitable for different thickness categories of spine regions of the book covers to be shaped and their associated book block are arranged. For example, a device equipped with two first and two second shaping tools can shape book covers having a straight spine region and also book covers having a round spine region for corresponding book blocks having a thickness of up to 60 mm.

As a result of the low number of shaping tools, it is possible to assign each shaping tool its own coded preheating station, the temperature of which can be set depending on the book cover to be processed. The temperature settings of the different materials are stored in the machine control system and can be assigned to the coded preheating stations on the basis of existing order data of the ensuing orders. Additionally, it is possible as a result of the coding of the shaping tools, to monitor their use in the machine and thus to prevent incorrect settings.

The gradation of the shaping tools according to thickness categories depends on other interchangeable parts of the book finishing machine such that a rational production within this grade is ensured. The gradations are therefore defined in relation to the book thickness such that within one gradation no interchangeable parts need to be changed over in any region of the book production line.

According to a further embodiment of the device according to the invention, the receiving element is designed as a heating element. Using this heating element, the shaping tool located in its working position in the device can both be kept at an operating temperature and brought up to this temperature.

FIG. 1 is a partial view of a device 1 according to the invention for shaping book covers 2 lying outstretched (FIG. 5, FIG. 7), which are each subsequently assembled together with a book block which has a straight spine to make a book.

Such a book cover 2 essentially consists of two lateral book boards 3, 3' and a central part, referred to as a spine region 4, which receives the spine of the book block (FIG. 4 to FIG. 9). On its inner face, the spine region 4 can be provided with a strengthening insert 5 consisting, for example, of cardboard or recycled paper. The book cover 2 has one folding region 6, 6' on either side of the spine region 4 which connects said spine region to the book boards 3 and forms an opening hinge in the finished book (FIG. 4 to FIG. 8).

As shown in FIG. 1, the device 1 is equipped with a first shaping tool 8, which is located in a working position 7 and moreover has been moved out of a lowered position into a raised position, and is coupled to an actuator 9 designed as a drive motor. Spindle or worm drives, for example, can, of course, also be used as the actuator.

Figure 2:
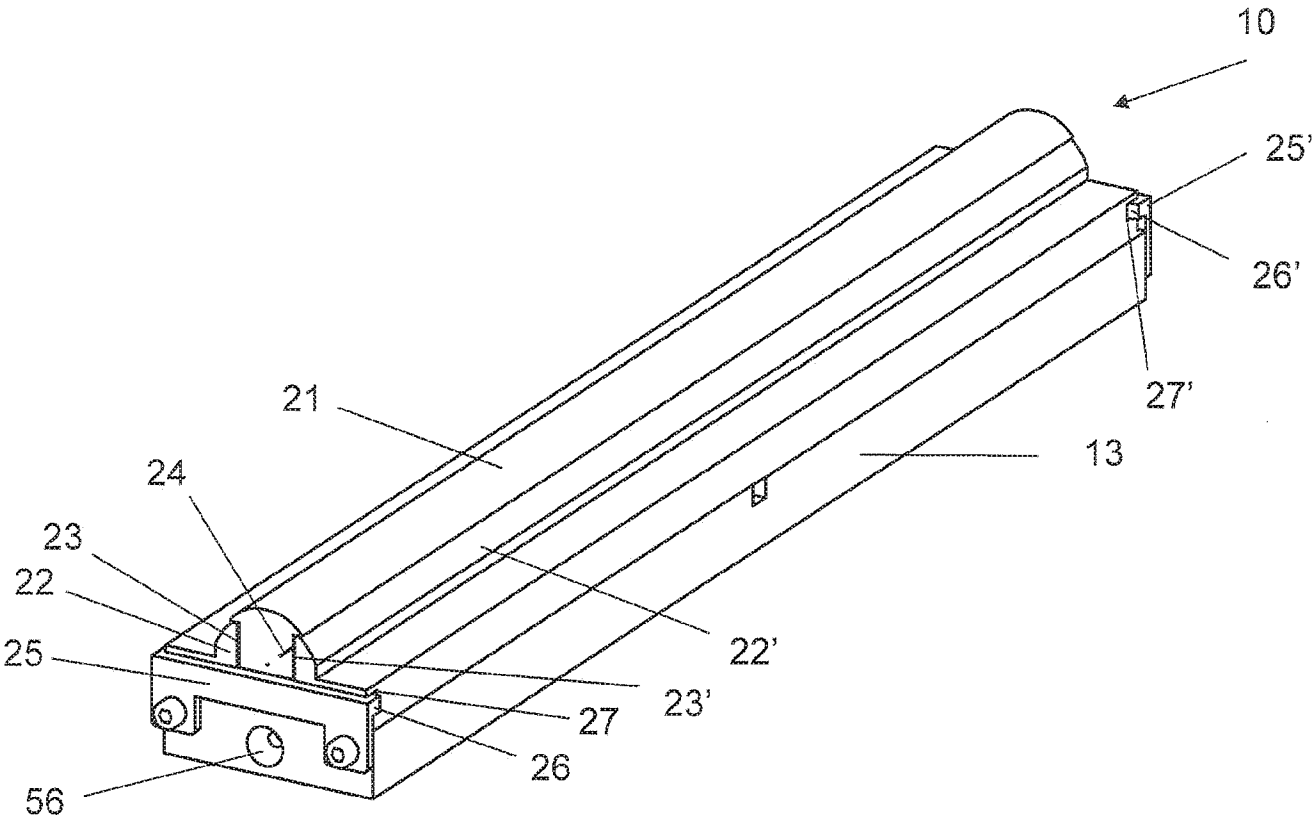
FIG. 2 is a spatial view of a second shaping tool of the device according to the invention, the actuator and the connecting element having been omitted.

FIG. 2 shows a second shaping tool 10 of the device 1, which is then coupled to the same actuator 9, if the book cover 2 lying outstretched in the device 1 is intended to be shaped into a book cover 2" having a round spine region 4" (FIG. 6, FIG. 8) instead of into a book cover 2' having a straight spine region 4' (FIG. 4) according to a current production order. During shaping using the first or the second shaping tool 8, 10, each of the two folding regions 6, 6', and in the case of a book cover 2 provided for a round book block using the second shaping tool 10 additionally also its spine region 4, are shaped out of the stretched position such that the shaped book cover 2', 2" is subsequently suitable to be bound to a corresponding book block to form a book.

As likewise shown in FIG. 1, the first shaping tool 8 has two first shaping rails 11, 11' which are spaced apart from one another, stand vertically and are aligned in parallel with the spine region 4 of the book cover 2 to be shaped. On their lower end, the shaping rails 11, 11' each have a base rail 12, 12', which base rails in turn rest on a common tool beam 13 in a laterally adjustable manner and are non-positively or positively connected to said tool beam. In this manner, the shaping rails 11, 11' can be mutually adjusted according to the required width of the spine region 4 of the book cover 2.

On their underside, the shaping rails 11, 11' are, for example, provided with permanent magnets, or with electromagnets, which can be switched on and off, which generate relatively high attraction forces on the upper face of the ferrous tool beam 13. These attraction forces provide for a close contact between the upper face of the tool beam 13 and the shaping rails 11, 11', such that good heat transfer into the shaping rails 11, 11' is ensured.

Figure 3:
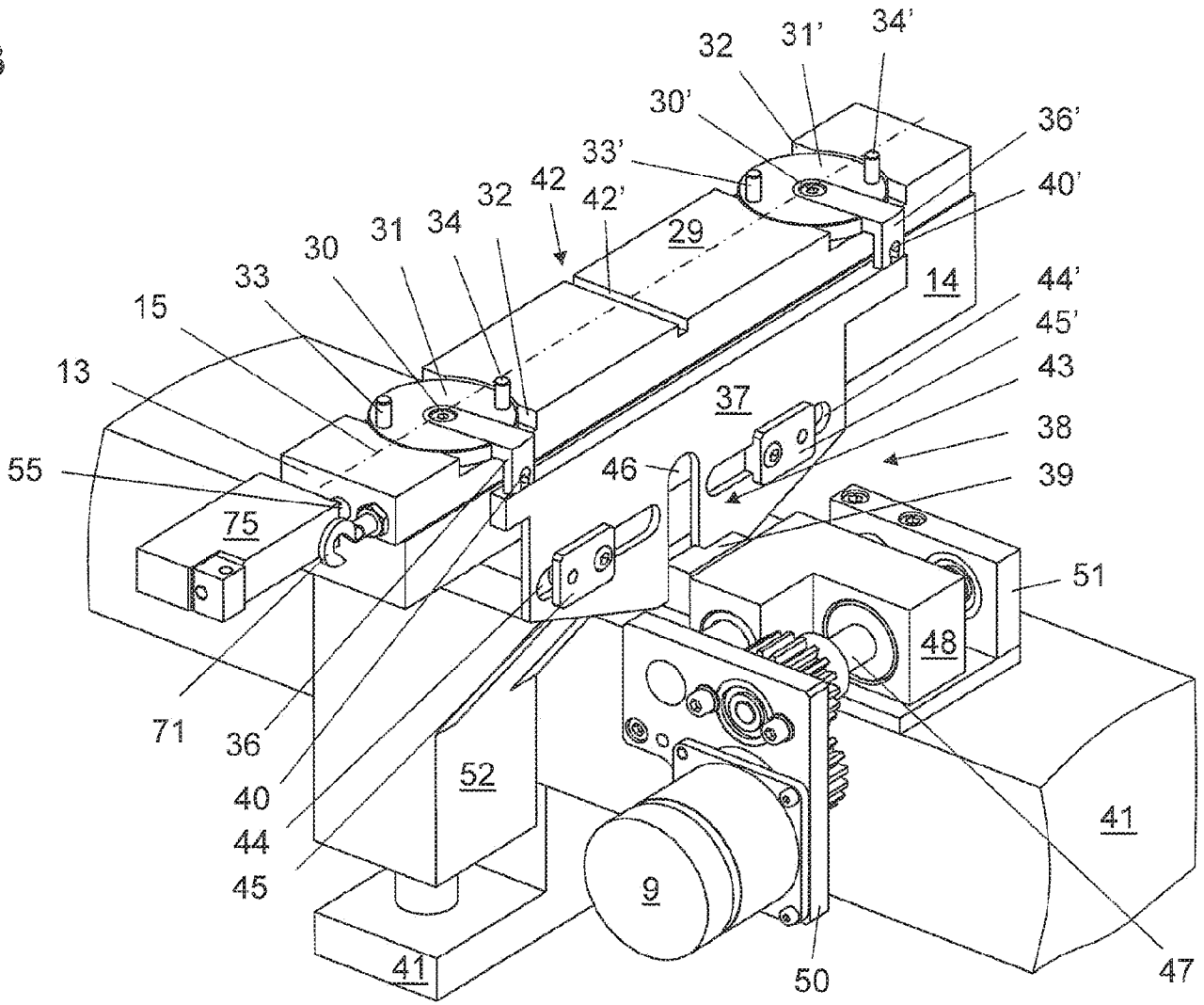
FIG. 3 is a view of the device from FIG. 1, with the shaping tool removed.

The tool beam 13 has approximately the length of the shaping rails 11, 11' and the base rails 12, 12' and is wider than the spacing between the shaping rails 11, 11' required for the largest book cover 2 to be shaped using the device 1. The tool beam 13 located like the first shaping tool 8 in its working position 7 rests on a receiving element 14 of the device 1. The actuator 9 is arranged to the side of an imaginary, vertical plane through a longitudinal central axis 15 of the tool beam 13 (FIG. 3). The shaping rails 11, 11' are arranged symmetrically to the longitudinal central axis 15 of the tool beam 13 and are designed so as to be adjustable symmetrically to this longitudinal central axis 15.

Figure 4:
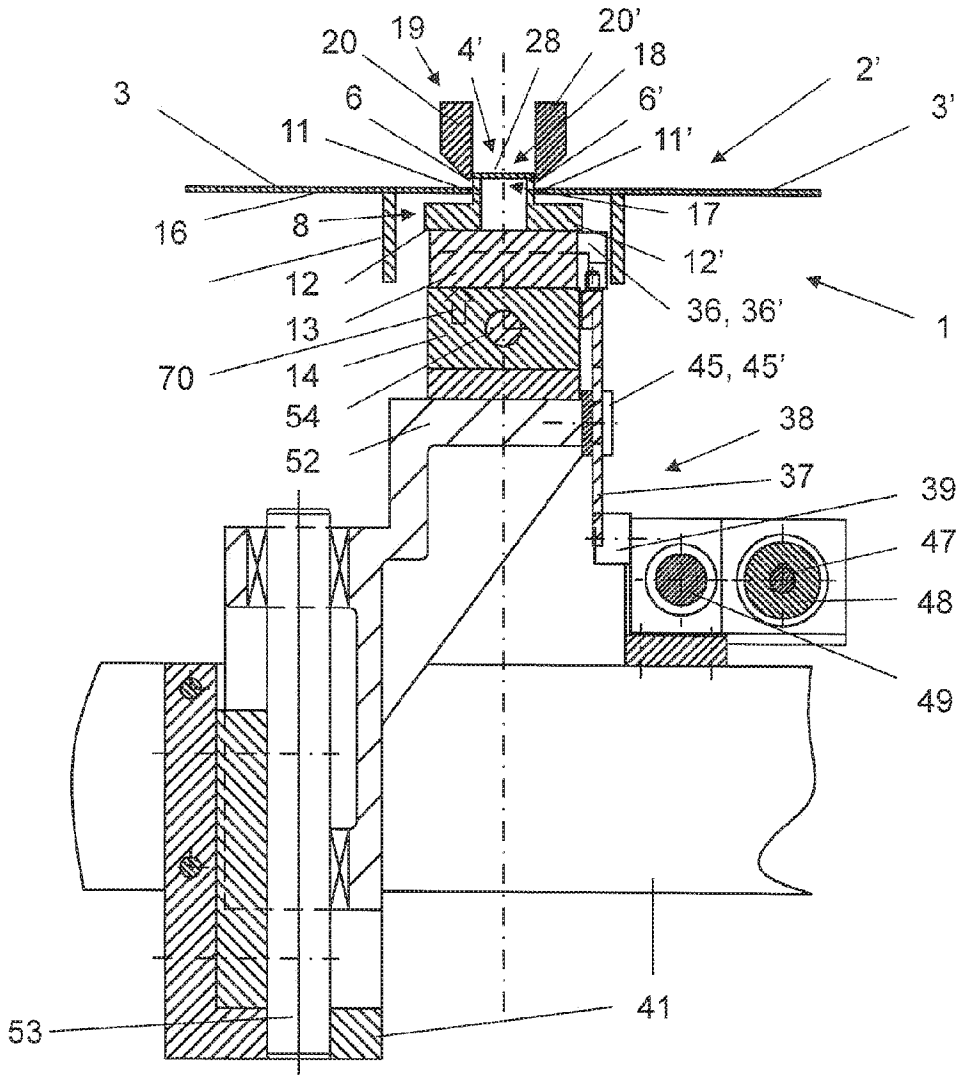
FIG. 4 is as cross section of the device shown in FIG. 1, showing a countertool and a shaped book cover.

In its lowered position, the first shaping tool 8, which at least almost extends beyond the height of a book cover, is initially located underneath and at a distance from a supporting flat surface 16 used to shape the book cover 2 and shown in FIG. 4, which extends transversely to the feed direction of the book block of a casing-in machine that is arranged downstream of the device 1, is used to connect the book block to the shaped book covers 2', 2".

In addition to the shaping tool 8, 10 located in the working position 7 in each case and aligned with an inner face 17 of the spine region 4', 4" of a book cover 2' to be shaped, the device 1 also has a countertool 19 which is arranged above the shaping tool 8, 10, interacts with said shaping tool and is aligned with an outer face 18 of the spine region 4', 4" of said book cover 2. The countertool 19 has two counter shaping rails 20, 20' which are spaced apart from one another, stand vertically and are oriented in parallel with the spine region 4 of the book cover 2 to be shaped (FIG. 4). These are likewise designed so as to be mutually adjustable according to the required width of the spine region 4 of the book cover 2.

According to FIG. 2, the second shaping tool 10 has a fixed, rounded central shaping strip 21 aligned towards the countertool 19 (FIG. 5) and two second rounded outer shaping rails 22, 22', which are arranged to the sides of the central shaping strip 21, laterally adjustable according to the rounding and the width of the spine region 4 of the book cover 2 to be shaped and likewise aligned towards the countertool 19. The central shaping strip 21 is symmetrical and has, in a region facing the tool beam 13, one recess 23, 23' on either side for each receiving the outer shaping rails 22, 22' at least in part. Said outer shaping rails are designed so as to be adjustable symmetrically to a longitudinal central axis 24 of the central shaping strip 21.

Similarly to the shaping rails 11, 11' of the first shaping tool 8, the outer shaping rails 22, 22' of the second shaping tool 10 are also provided, on their underside, for example, with permanent magnets, or with electromagnets, which can be switched on and off and generate relatively high attraction forces on the upper face of the ferrous tool beam 13. These attraction forces provide for a close contact between the upper face of the tool beam 13 and the outer shaping rails 22, 22', such that good heat transfer to said shaping rails 22, 22' and therefore also to the book cover 2 to be shaped is ensured. In addition to the described attraction forces, two end-face guides 25, 25' can absorb the processing forces during shaping of the relevant book cover 2. For this purpose, two protrusions 26, 26' of each of the two end-face guides 25, 25' penetrate into end-face grooves 27, 27' in the outer shaping rails 22, 22' and hold these in contact with the tool beam 13. The two-end face guides 25, 25' can be set such that they withstand a thermal expansion of several hundred degrees without impairment and do not counteract a slight movement of the outer shaping rails 22, 22'.

In order to shape the folding regions 6, 6' of the book cover 2 provided on either side of the spine region 4, the relevant shaping tool 8, 10 together with the tool beam 13 is first raised against the countertool 19 arranged thereabove and its counter shaping rails 20, 20' and, in the process, a spine strip 28 of the book cover 2', 2" is formed using the shaping rails 11, 11' and using the central shaping strip 21 and the outer shaping rails 22, 22'. In the process, the curvatures of the central shaping strip 21 and the outer shaping rails 22, 22' of the second shaping tool 10 additionally ensure the rounding of the spine region 4" of the book cover 2" according to the rounding of the spine of an associated book block.

FIG. 3 is a partial view of the device 1 according to the invention, with the shaping tool 8, 10 removed. A smooth support surface 29 of the tool beam 13, which acts as a flat feed surface, is consequently visible, and has good sliding properties for the shaping tool 8, 10 located in its working position 7 in each case. As can be seen, the tool beam 13 is also used to receive rotating members, for example discs 31, 31', driven about vertical axes of rotation 30, 30', which are mounted in recesses 32, 32' in the tool beam 13 which are spaced apart from one another along the tool beam 13. On their side aligned with the shaping tool 8, 10 located in the working position 7, the discs 31, 31' have catches 33, 34, 33', 34' opposite one another in relation to the relevant axis of rotation 30, 30'.

The discs 31, 31' are lowered into the tool beam 13 such that they do not touch the shaping tool 8, 10 located in the working position 7. In their side resting on the tool beam 13, the shaping tools 8, 10 each have recesses 35, 35' which are aligned in parallel with the axis of rotation 30, 30' of the discs 31, 31' and are at least partially penetrated by the catches 33, 34, 33', 34' designed, for example, as studs. Only the corresponding interaction between one of the catches 34, 34' and one of the recesses 35, 35' in the base rail 12', which is at the front in FIG. 1, of the first shaping tool 8 is shown. The rear base rail 12, of course, also has corresponding recesses 35, 35', which are, however, hidden here, in each of which a catch 33, 33' engages.

So that an optimally effective, lateral stroke of the shaping rails 11, 11' of the first forming tool 8 connected to the base rails 12, 12' and of the outer shaping rails 22, 22' of the second shaping tool 10 mutually directed against one another can be achieved, the catches 33, 34, 33', 34' of a disc 31, 31' are aligned in an initial position, for example, at an angle of approximately 45° to the longitudinal central axis 15 of the tool beam 13 so as to be diametrically opposite one another (FIG. 3). The rotary movements of the discs 31, 31' are achieved by a movement cam 36, 36' fastened on the circumference of each disc 31, 31' and projecting laterally over the tool beam 13, by means of a slider 37 of a sliding device 38, which is connected to an actuating cam 39. An even change of the distance between the shaping rails 11, 11' of the first shaping tool 8 or between the outer shaping rails 22, 22' of the second shaping tool 10 is thus ensured. The adjustment and setting of this distance can be achieved by means of a motor force or manual force. To increase accuracy, a control system connected to a variable motor can be used.

The movement cams 36, 36' protruding on one side of the tool beam 13 are connected by means of joints 40, 40' or lateral guides to the slider 37, which is mounted on a frame 41 of the device 1 in an oscillating manner or so that it can be moved back and forth. As a result of a common rotation of the discs 31, 31', the catches 33, 34, 33', 34' each move inwards or outwards and, in the process, reduce or enlarge the distance between the shaping rails 11, 11' of the first shaping tool 8 or between the outer shaping rails 22, 22' of the second shaping tool 10.

So that the shaping rails 11, 11' of the first shaping tool 8 or the outer shaping rails 22, 22' of the second shaping tool 10 do not move relative to one another in their longitudinal direction when the discs 31, 31' rotate, a first guide arrangement 42 is provided between the tool beam 13 and the shaping tool 8, 10, which is located in the working position in each case, transverse to its longitudinal extension, which, for example, has a groove 42' in the tool beam 13 extending transversely to the longitudinal direction of said components and a pin 42" (FIG. 1) or similar of the shaping tool 8, 10 engaging therein. In this manner, it is ensured that the shaping rails 11, 11' or the outer shaping rails 22, 22' are only adjustable transversely to the longitudinal extension of the relevant shaping tool 8, 10. This constitutes an alternative solution to the end-face guides 25, 25' described above.

FIG. 4 is a cross section of the device 1 equipped with a first shaping tool 8 and a countertool 19, and an already shaped book cover 2' having a straight spine region 4' and having the two shaped folding regions 6, 6'. Shown here is the arrangement of the shaping tool 8 likewise connected to the frame 41 and of the sliding device 38 connected to the shaping tool 8 by means of the slider 37. The slider 37, which is connected to the discs 31, 31' in a drivable manner and extends flat downwards has a second guide arrangement 43 (FIG. 3), which provides for its slidability parallel to the longitudinal extension of the tool beam 13. The second guide arrangement 43 has two slots 44, 44' which extend in this sliding direction and are spaced apart from one another and one slide block 45, 45' fastened to the frame 41, assigned to each of the slots 44, 44' and entering said slots, on which the slider 37 is moved back and forth.

Between the slots 44, 44', a slit-like opening 46 (FIG. 1, FIG. 3) reaching from below to above is provided for the actuating cams 39 designed as drivers, which is indirectly connected to the actuator 9. The opening 46 allows a raising and lowering of the first shaping tool 8 connected to the frame 41.

As can be seen from FIGS. 1, 3 and 4, the actuator 9 shown is a gear motor, the drive shaft 47 of which is designed as a spindle. The drive shaft 47 passes through and engages with a spindle nut of a regulating element 48 guided on a rod 49 in the direction of the sliding movements of the slide 37, to which element the actuating cam 39 is fastened. In order to mount the drive shaft 47, a bearing shield 50 connected to the frame 41 and a bearing block 51 are provided. Instead of this, a rack and pinion drive can, of course, also be provided as the regulating device.

According to FIG. 4, the raising of the first shaping tool 8 takes place by means of a bracket 52, which is connected to the receiving element 14 of the tool beam 13 and interacts with a piston-cylinder unit, which is known, along a guide rod 53 fixed to the frame 41 of the device 1 or with another lift drive. As a result of the raising of the first shaping tool 8, the spine region 4' of the book cover 2' is raised up by means of the two shaping rails 11, 11' spaced apart from one another between the opposing counter shaping rails 20, 20' of the countertool 19 forming a spine strip 28 and shaped under the effect of heat. In the process, the folding regions 6, 6' located on either side of the spine region 4' are shaped into opening hinges. For this purpose, the receiving element 14 arranged underneath the tool beam 13 is designed as a heating element equipped with heating rods 54 from which the heat is transferred via the tool beam 13, the base rails 12, 12' and ultimately via the shaping rails 11, 11' to the spine region 4' to be shaped of the book cover 2' in order to keep the shaping tool 8 at the operating temperature.

For an accurate positioning of the shaping tool 8, 10, a centering apparatus 75, for example, connected to the receiving element 14 and having a conical positioning pin 55, is provided (FIG. 1, FIG. 3), which is engaged under spring pressure in a drilled hole 56 provided therefor (FIG. 2) on the end face of the tool beam 13.

With respect to the further configuration of the drive and of the connecting elements to the shaping tools of the device 1, reference is made to EP2325020 A1 mentioned at the outset, which is to be understood to be an integral component of the device 1 in this respect.

Figure 5:
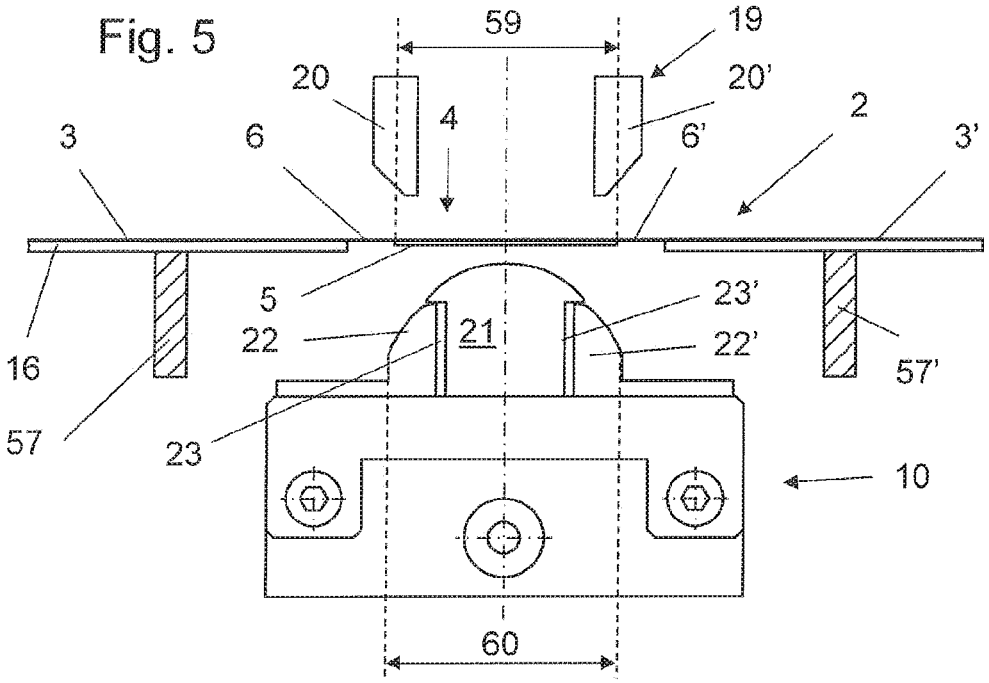
FIG. 5 is a detail of the device according to the invention, showing the second shaping tool, the countertool and a book cover of a first format ready for shaping.
Figure 9:
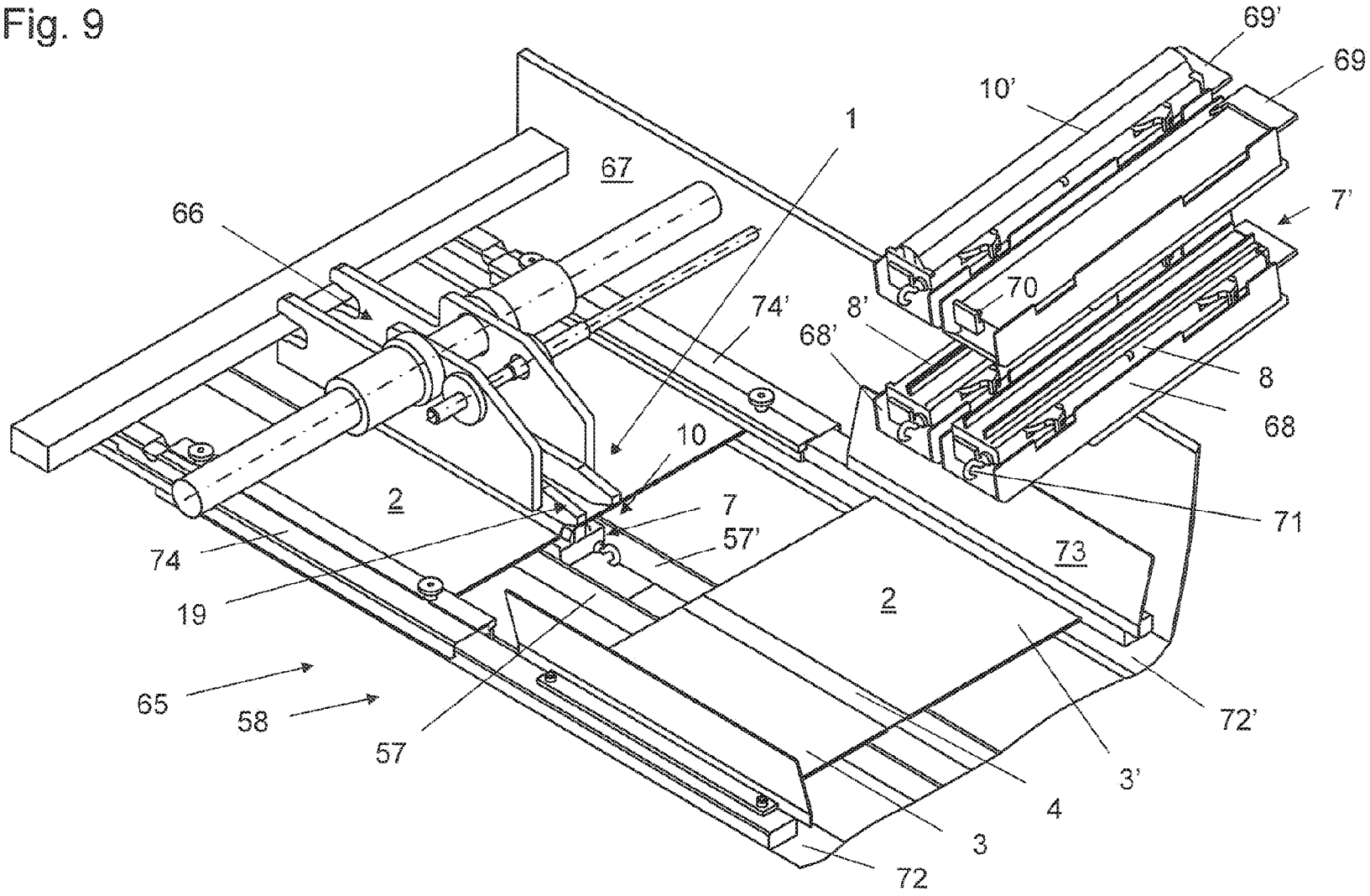
FIG. 9 is a perspective plan view of a device according to the invention, which is integrated in a cover feed by way of example, which in turn has four preheating stations for shaping tools.

FIG. 5 shows a detail of the device 1 with the second shaping tool 10 in its working position 7, with the counter shaping rails 20, 20' of the counter tool 19 and a book cover 2 ready to be shaped on inner support elements 57, 57' of a cover feed 58 (FIG. 9). The second shaping tool 10 is still located in its lowered position, i.e. underneath the flat support surface 16 and is therefore at a distance from the book cover 2. In this position, the second shaping tool 10 is adjusted to a width 59 of the insert 5 of the spine region 4 of the book cover 2. For this purpose, the outer shaping rails 22, 22' of the second shaping tool 10 on the support surface 29 (FIG. 3) of the tool beam 13 are pushed further into the recesses 23, 23' in the central shaping strip 21 or further out of said recesses 23, 23' depending on the width 59 of the insert 5. The shape and equivalent radius of the second shaping tool 10 is determined by the thus adjusted external width 60 of the outer shaping rails 22, 22'.

Figure 6:
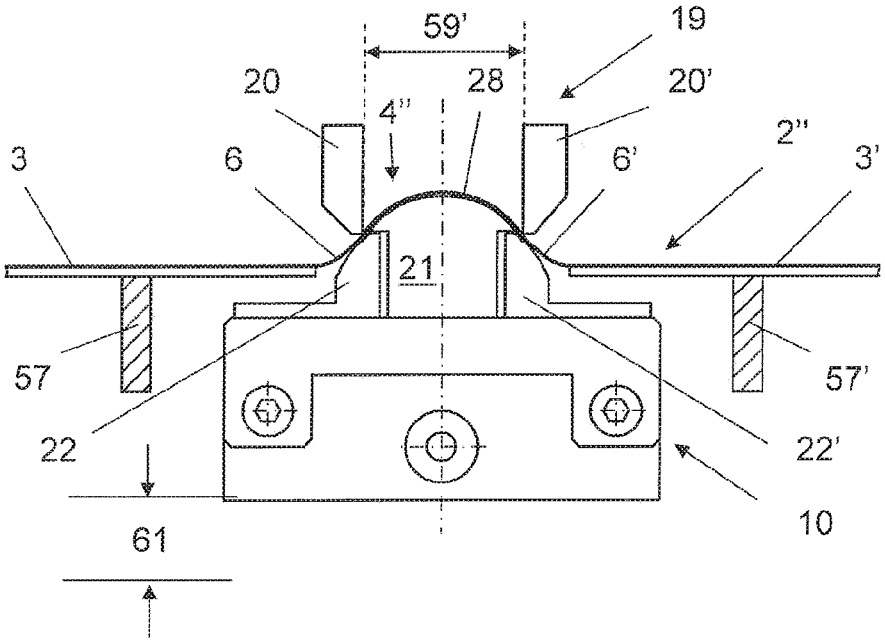
FIG. 6 is a detail of the device according to the invention according to FIG. 5, but with a rounded book cover.

FIG. 6 shows the second shaping tool 10 in its position in which it has in the meantime been raised upwards by one stroke 61 out of the position shown in FIG. 5. The stroke 61 depends on the thickness of the relevant book block and the associated book cover 2 and is calculated by a machine control system and is transferred to the second shaping tool 10 as already described with regard to raising the first shaping tool 8. After shaping, the insert 5 and therefore the now rounded spine region 4" of the book cover 2" has shortened from its original width 59 to a projected width 59' thus forming a spine strip 28, inner edges of the counter shaping rails 20, 20' aligning with outer edges of the insert 5. The projected width 59' of the insert 5 therefore corresponds to a thickness of the associated, rounded and backed book block.

Figure 7:
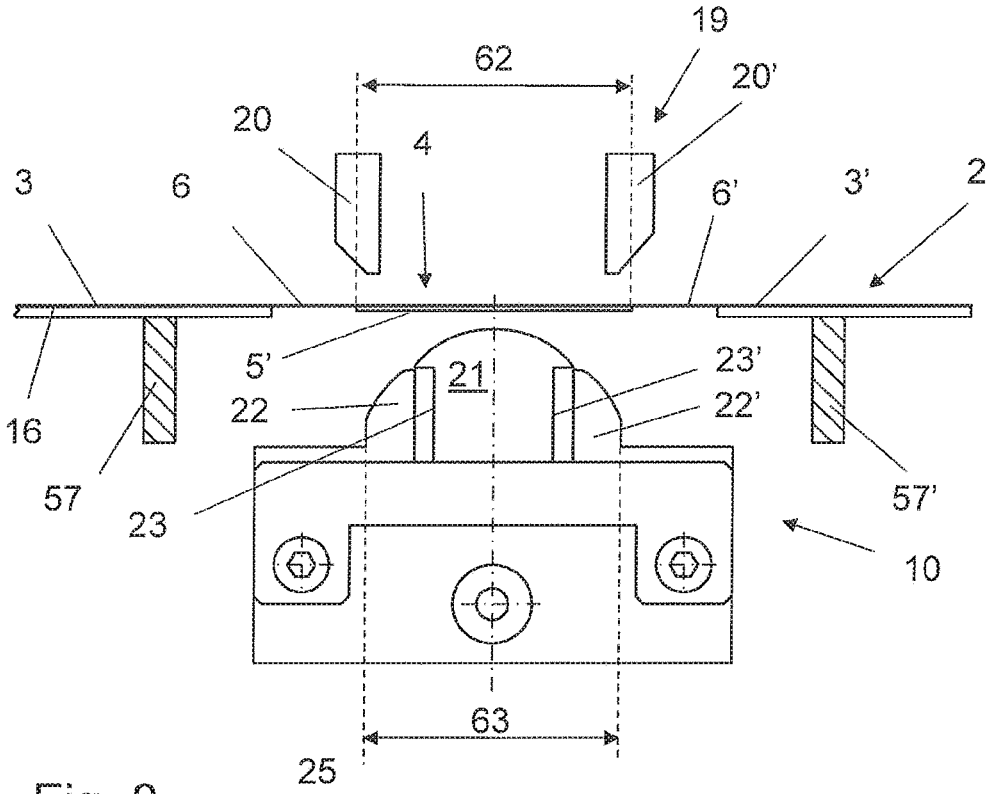
FIG. 7 is a detail of the device according to the invention similar to FIG. 5, but with a book cover of a second format.

Similarly to FIG. 5, FIG. 7 shows a detail of the device 1 with the second shaping tool 10 likewise located in its lowered position of the working position 7, with the counter shaping rails 20, 20' of the countertool 19, but with a book cover 2 ready to be shaped with a different format associated with a rounded and backed book block with a different thickness. The second shaping tool 10 is therefore adjusted to a width 62 of an insert 5', which has a different format, of the spine region 4 of the book cover 2, which likewise has a different format. As a result of a movement of the outer shaping rails 22, 22' on the tool beam 13 to a second outside width 63, the new shape and equivalent radius of the second shaping tool 10 is adjusted. To do this, in contrast to the view in FIG. 5, the outer shaping rails 22, 22' have been adjusted outwards symmetrically to the longitudinal central axis 24 of the central shaping strip 21.

Figure 8:
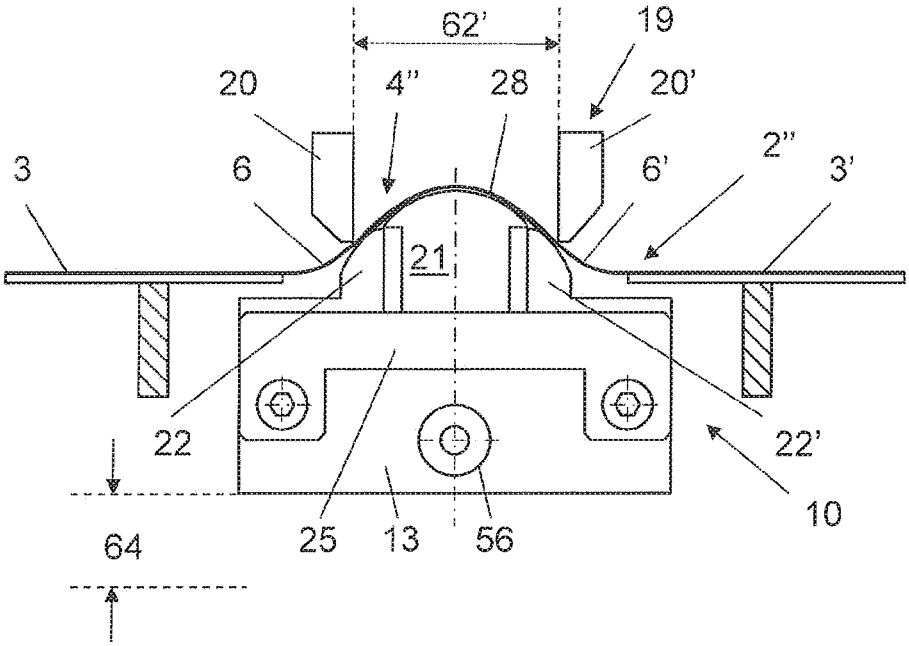
FIG. 8 is a detail of the device according to the invention similar to FIG. 7, but with a rounded book cover of the second format.

Similarly to FIG. 6, FIG. 8 shows the second shaping tool 10, which has, however, been adjusted according to FIG. 7, in its position in which it has in the meantime been raised upwards by one stroke 64 out of the position shown in FIG. 7. After shaping, the insert 5', which has a different format, of the spine region 4 and therefore the now rounded spine region 4" of the book cover 2" has been shortened from the original width 62 to a projected width 62', inner edges of the counter shaping rails 20, 20' likewise aligning with outer edges of the insert 5'. The stroke 64 of the second shaping tool 10 has, as described with reference to FIG. 6, been calculated and automatically adjusted.

FIG. 9 is a perspective plan view of a device 1 according to the invention and of two first shaping tools 8, 8' suitable for different thickness categories of spine regions 4 of the book covers 2 to be shaped and of two second shaping tools 10, 10' suitable for different thickness categories of spine regions 4 of the book covers 2 to be shaped.

The device 1 is integrated by way of example in the cover feed 58 of a book production line 65, which is merely indicated here. In this view, the device 1 is accordingly largely hidden by the cover feed 58 and the book covers 2 located thereon. Consequently, in FIG. 9 all that can be seen of the device 1 is the countertool 19 comprising a suspension bracket 66 in a machine frame 67 of the cover feed 58 and a second shaping tool 10 accommodated in the device 1 in its working position 7.

Likewise integrated in the cover feed 58 are four preheating stations 68, 68', 69, 69', i.e. one separate preheating station 68, 68', 69, 69' for each shaping tool 8, 8', 10, 10'. When the device 1 is in operation, one of the shaping tools 8, 8', 10, 10' is always installed in the device 1. According to FIG. 9, the second shaping tool 10 is located in the device 1, while the two first shaping tools 8, 8' and the other second shaping tool 10' are each in a preheating station 68, 68', 69' and are currently being heated up or are waiting at their set temperature for their next deployment. They are therefore in a resting position 7'.

Likewise, a preheating station 69 is provided for the second shaping tool 10 installed in the device 1, which preheating station is, however, currently empty. Empty preheating stations 68, 68', 69, 69' can be set to a lower temperature directly by the machine operator or via a control system. In the process, which preheating stations 68, 68', 69, 69' are currently empty is monitored as is which shaping tool 8, 8', 10, 10' is therefore located in the device 1 and whether this shaping tool 8, 8', 10, 10' is suitable for the current order. The preheating stations 68, 68', 69, 69' can be structurally designed such that they are each only suitable for receiving one particular shaping tool 8, 8', 10, 10'. In the example in FIG. 9, only the shaping tool 10 which is currently in its working position 7 would then fit in the empty preheating station 69.

Even though a quicker format change of the book covers 2 to be shaped can thus be achieved, a separate preheating station 68, 68', 69, 69' does not have to be arranged, of course, for each shaping tool 8, 8', 10, 10'. Generally, it is sufficient if the shaping tool 8, 8', 10, 10' to be transported into its working position 7 in each case can be taken out of its resting position 7' in a preheating station 68, 68', 69, 69'.

In order to monitor which preheating stations 68, 68', 69, 69' are currently empty, and which shaping tool 8, 8', 10, 10' is therefore located in the device 1 and whether this shaping tool 8, 8', 10, 10' is suitable for the current order, an appropriate sensor 70 can be arranged. For example, the sensor 70 can be fastened in at least one of the preheating stations 68, 68', 69, 69' (FIG. 9) or on the receiving element 14 for the tool beam 13 (FIG. 4).

According to FIG. 9, the shaping tools 8, 8', 10, 10' each have a lifting hook 71 on an end face of the tool beam 13 thereof. This is used to lift a shaping tool 8, 8', 10, 10' out of or install it in its working position 7 or resting position 7', respectively, by means of a lifting gear.

Finally, in addition to the two inner support elements 57, 57', the cover feed 58 has two more outer support elements 72, 72' for the book covers 2, a support apparatus 73 for introducing book covers 2 and security rails 74, 74' for preventing the book cover 2 from rising up during the shaping process.

While the invention has been illustrated and described in detail in the drawings and foregoing description, such illustration and description are to be considered illustrative or exemplary and not restrictive. It will be understood that changes and modifications may be made by those of ordinary skill within the scope of the following claims. In particular, the present invention covers further embodiments with any combination of features from different embodiments described above and below. Additionally, statements made herein characterizing the invention refer to an embodiment of the invention and not necessarily all embodiments.

The terms used in the claims should be construed to have the broadest reasonable interpretation consistent with the foregoing description. For example, the use of the article "a" or "the" in introducing an element should not be interpreted as being exclusive of a plurality of elements. Likewise, the recitation of "or" should be interpreted as being inclusive, such that the recitation of "A or B" is not exclusive of "A and B," unless it is clear from the context or the foregoing description that only one of A and B is intended. Further, the recitation of "at least one of A, B and C" should be interpreted as one or more of a group of elements consisting of A, B and C, and should not be interpreted as requiring at least one of each of the listed elements A, B and C, regardless of whether A, B and C are related as categories or otherwise. Moreover, the recitation of "A, B and/or C" or "at least one of A, B or C" should be interpreted as including any singular entity from the listed elements, e.g., A, any subset from the listed elements, e.g., A and B, or the entire list of elements A, B and C.

What is claimed is:

1. A device for shaping a folding region of a lying outstretched book cover, the folding region being adjacent on either side of a spine region, or for shaping the spine region and the folding region, corresponding to a shape of a spine of a book block which subsequently forms a book together with the book cover, the device comprising:

at least one first shaping tool for a first book cover associated with a first book block having a straight spine;

at least one second shaping tool configured to generate a rounding of the spine region of the book cover for a second book cover associated with a second book block having a round spine;

a working position for one of the shaping tools and a resting position for the other shaping tools;

a countertool which is aligned with an outer face of the spine region of the book cover and has two counter shaping rails which are spaced apart from one another and are adjustable laterally according to a width of the spine region of the book cover, wherein, in a working position, a respective one of the shaping tools is arranged so as to be aligned with an inner face of the spine region of the book cover and is configured to raise the spine region of the book cover between the two counter shaping rails so as to form a spine strip of the book cover;

one tool beam which is non-positively or positively connected to each of the shaping tools;

a receiving element for the tool beam arranged in the working position; and a single actuator for the shaping tools in each case arranged in the working position, the tool beam in each case being arranged in the working position being configured to be coupled to the single actuator, wherein each of the shaping tools has two shaping rails which are spaced apart from one another, are laterally adjustable and are each designed so as to be adjustable collectively to change a distance therebetween.

2. The device according to claim 1, wherein the actuator is arranged to a side of an imaginary vertical plane through a longitudinal central axis of the tool beam located in the working position.

3. The device according to either claim 1, wherein at least one preheating station arranged for the at least one shaping tool located in the resting position.

4. The device according to claim 3, wherein the at least one preheating station is arranged in or on the device or in a vicinity of the device.

5. The device according to claim 4, wherein a separate preheating station is arranged for each one of the shaping tools.

6. The device according to claim 1, wherein at least one sensor is arranged for identifying the shaping tools.

7. The device according to claim 6, wherein the at least one sensor is arranged in at least one preheating station.

8. The device according to claim 6, wherein the at least one sensor is arranged on the receiving element for the tool beam.

9. The device according to claim 1, wherein the at least one first shaping tool has two shaping rails which are spaced apart from one another and are arranged so as to be laterally adjustable according to the width of the spine region of the book cover.

10. The device according to claim 1, wherein the at least one second shaping tool has a fixed central shaping strip, which is rounded towards the countertool, and two outer shaping rails, which are arranged to the sides of the central shaping strip and are laterally adjustable according to a rounding and the width of the spine region of the book cover, the shaping rails being rounded towards the countertool.

11. The device according to claim 10, wherein the central shaping strip is symmetrical and has a recess on either side of a region facing the tool beam configured to receive the outer shaping rails, at least in part.

12. The device according to claim 11, wherein the outer shaping rails are adjustable symmetrically to a longitudinal central axis of the central shaping strip.

13. The device according to claim 1, further comprising at least two first shaping tools, each suitable for different thickness categories of different spine regions of the book covers to be shaped, and at least two second shaping tools, each suitable for different thickness categories of different spine regions of the book covers to be shaped.

14. The device according to claim 1, wherein the receiving element is designed as a heating element.

* * * * *